US006557352B2

(12) United States Patent
Luo

(10) Patent No.: US 6,557,352 B2
(45) Date of Patent: May 6, 2003

(54) FLUID CONDUIT WITH ENHANCED THERMAL CONDUCTING ABILITY

(76) Inventor: Chin-Kuang Luo, 5F, No. 56, Min-Chuan Rd., Chung Dist., Taichung City (TW)

( * ) Notice: Subject to any disclaimer, the term of this patent is extended or adjusted under 35 U.S.C. 154(b) by 61 days.

(21) Appl. No.: 09/951,174

(22) Filed: Sep. 13, 2001

(65) Prior Publication Data

US 2002/0034381 A1 Mar. 21, 2002

(30) Foreign Application Priority Data

Sep. 16, 2000 (TW) ..... 89119069 A

(51) Int. Cl.[7] ..... F25B 21/00
(52) U.S. Cl. ..... 62/3.2
(58) Field of Search ..... 62/3.2, 3.5, 3.6, 62/3.7, 169

(56) References Cited

U.S. PATENT DOCUMENTS 3,800,061 A 3/1974 Larson et al. ..... 174/15 C
5,761,909 A 6/1998 Hughes et al. ..... 62/3.7
5,890,371 A * 4/1999 Rajasubramanian et al. . 62/259.2
5,901,572 A * 5/1999 Peiffer et al. ..... 62/480
5,927,078 A * 7/1999 Watanabe et al. ..... 62/3.6
5,931,001 A * 8/1999 Watanabe et al. ..... 62/3.7
6,058,712 A * 5/2000 Rajasubramanian et al. .. 62/3.6
6,158,225 A * 12/2000 Muto et al. ..... 62/3.7
6,191,943 B1 * 2/2001 Tracy ..... 361/687

FOREIGN PATENT DOCUMENTS

WO WO 98/17740 4/1998

* cited by examiner

*Primary Examiner*—William C. Doerrler
*Assistant Examiner*—Malik N. Drake
(74) *Attorney, Agent, or Firm*—Trop, Pruner & Hu, P.C.

(57) ABSTRACT

A fluid conduit includes a hollow inner tube which is made of a heat-conducting material and which confines a first chamber, and a hollow outer tube which is made of a heat-conducting material, which is disposed concentrically around the inner tube, and which cooperates with the inner tube to form a second chamber. One of the first and second chambers is adapted to permit passage of fluid therethrough. The other one of the first and second chambers has opposing closed ends, and is filled with a superconductor material so as to provide the fluid conduit with an enhanced thermal conducting ability.

33 Claims, 14 Drawing Sheets

FLUID CONDUIT WITH ENHANCED THERMAL CONDUCTING ABILITY

CROSS-REFERENCE TO RELATED APPLICATION

This application claims priority of Taiwan patent Application No. 089119069, filed on Sep. 16, 2000.

BACKGROUND OF THE INVENTION

1. Field of the Invention

This invention relates to a fluid conduit, more particularly to a fluid conduit with an enhanced thermal conducting ability.

2. Description of the Related Art

Conventional methods for transmitting thermal energy generally require a large amount of electrical energy.

SUMMARY OF THE INVENTION

The object of the present invention is to provide a fluid conduit which has an enhanced thermal conducting ability to conserve electrical energy.

According to this invention, the fluid conduit includes a hollow inner tube which is made of a heat-conducting material and which confines a first chamber, and a hollow outer tube which is made of a heat-conducting material, which is disposed concentrically around the inner tube, and which cooperates with the inner tube to form a second chamber. One of the first and second chambers is adapted to permit passage of fluid therethrough. The other one of the first and second chambers has opposing closed ends, and is filled with a superconductor material, thereby providing the fluid conduit with an enhanced thermal conducting ability.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
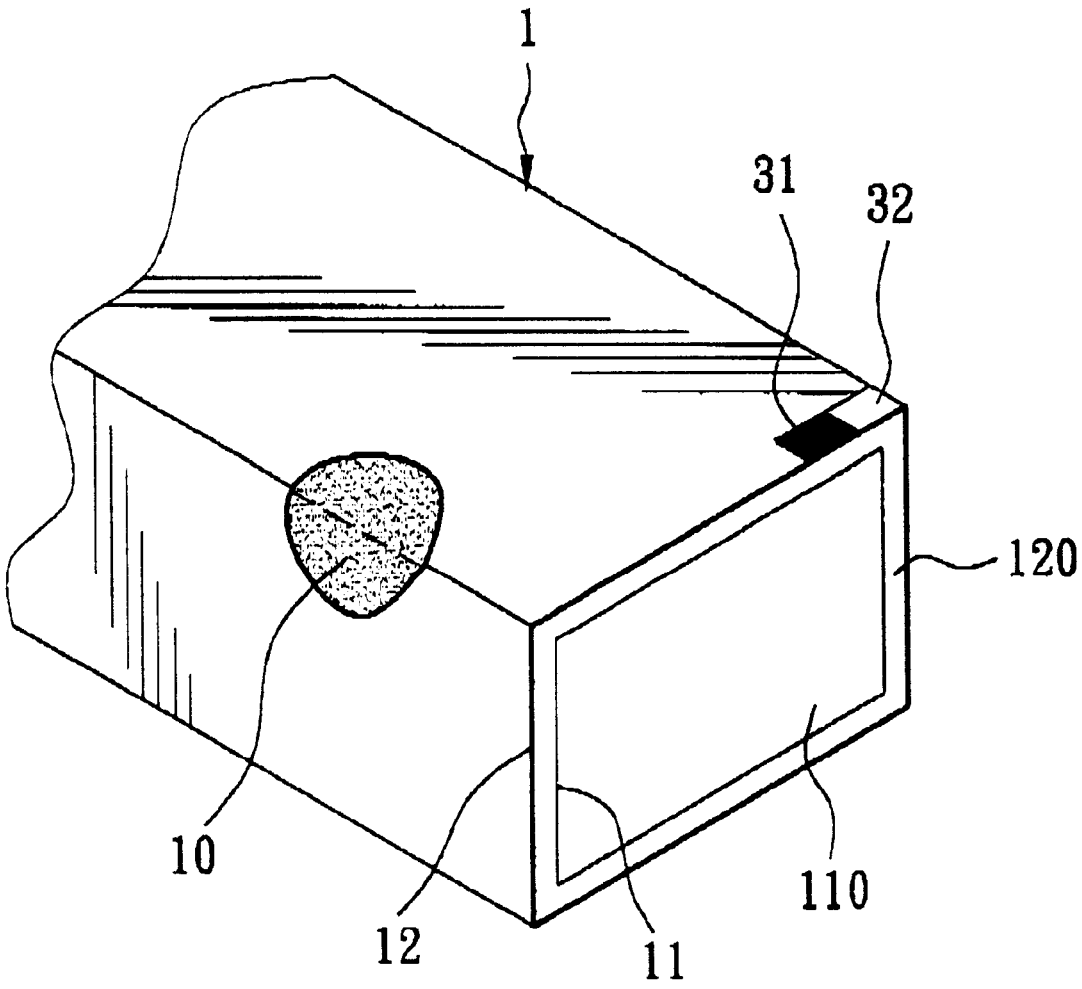
FIG. 1 is a perspective view of a first preferred embodiment of a fluid conduit according to this invention.

Before the present invention is described in greater detail, it should be noted that same reference numerals have been used to denote like elements throughout the specification.

Referring to FIG. 1, the first preferred embodiment of the fluid conduit 1 according to the present invention is shown to comprise a hollow inner tube 11 which is made of a heat-conducting material, such as carbon steel, and which confines a first chamber 110 that is adapted to permit passage of fluid therethrough, such as air, and a hollow outer tube 12 that is made of a heat-conducting material, such as carbon steel, that is disposed concentrically around the inner tube 11, and that cooperates with the inner tube 11 to form a vacuum second chamber 120. The inner and outer tubes 11, 12 are formed integrally by extrusion. The second chamber 120 has opposing closed ends, and is filled with a superconductor material 10, such as an inorganic superconductor in powder form, so that the superconductor material 10 can adhere to the inner and outer tubes 11, 12 in the vacuum interior of the second chamber 120. The superconductor material 10 has an applicable temperature range (no change in physical state) of about −50° C. to 1700° C., and is a non-radioactive material. A thermoelectric module 31 and/or a heat generating module 32 is mounted on an outer wall surface of the outer tube 12. By virtue of the superconductor material 10, thermal energy from the thermoelectric module 31 or the heat generating module 32 can be transmitted effectively over the wall surfaces of the inner and outer tubes 11, 12.

Figure 2:
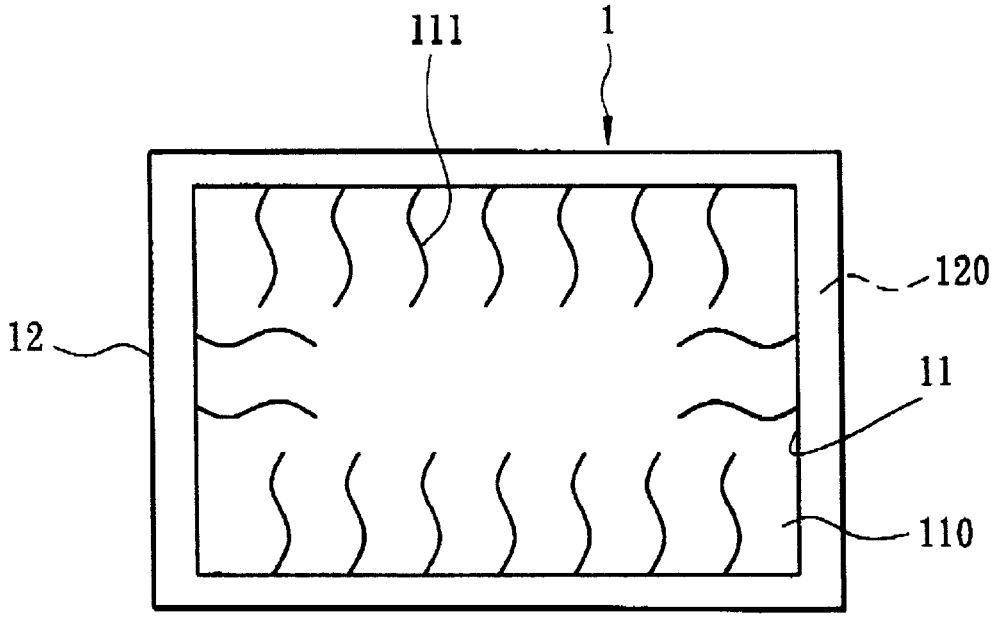
FIGS. 2 and 3 are end and perspective views of a second preferred embodiment of the fluid conduit according to this invention.
Figure 3:
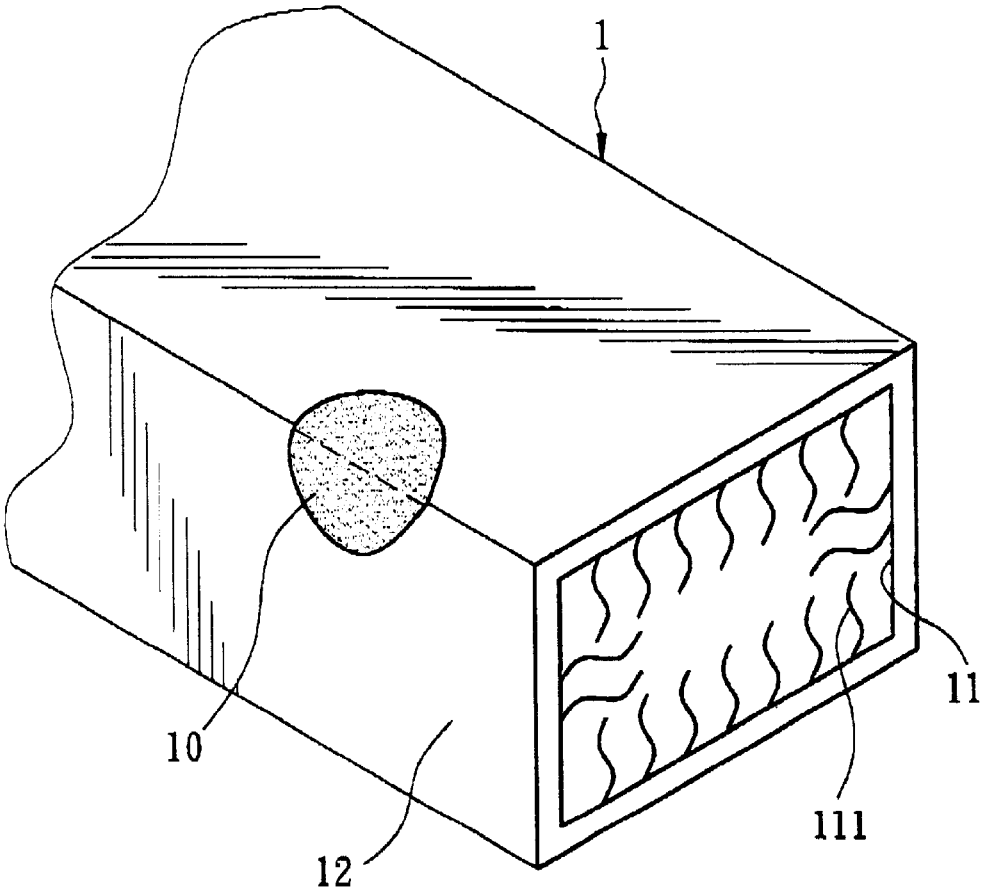

In the second preferred embodiment shown in FIGS. 2 and 3, the fluid conduit 1 further includes a plurality of thermal conducting fins 111 which extend radially, and inwardly and integrally from an inner wall surface of the inner tube 11 into the first chamber 110 so as to increase the thermal conducting area.

Figure 4:
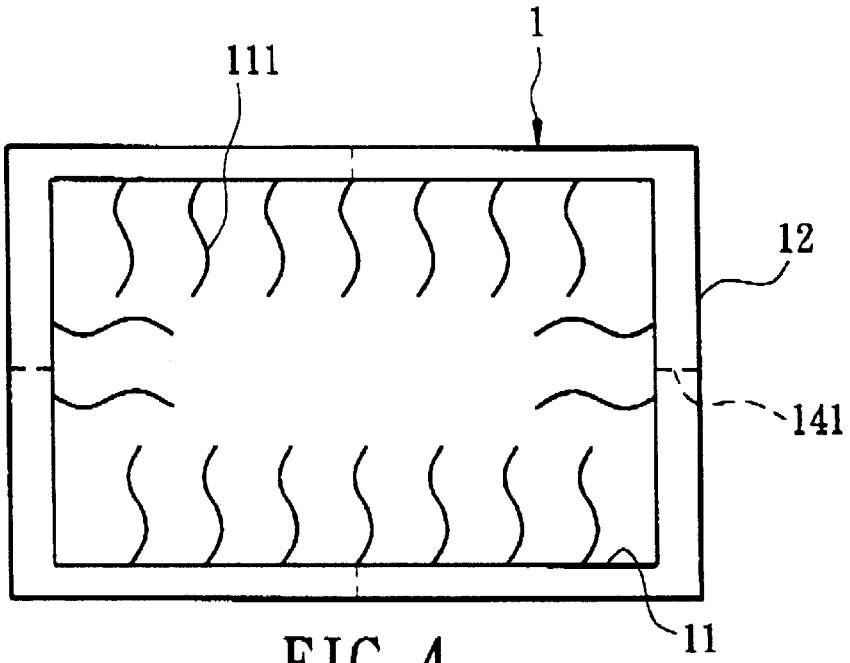
FIGS. 4 and 5 are end and perspective views of a third preferred embodiment of the fluid conduit according to this invention.
Figure 5:
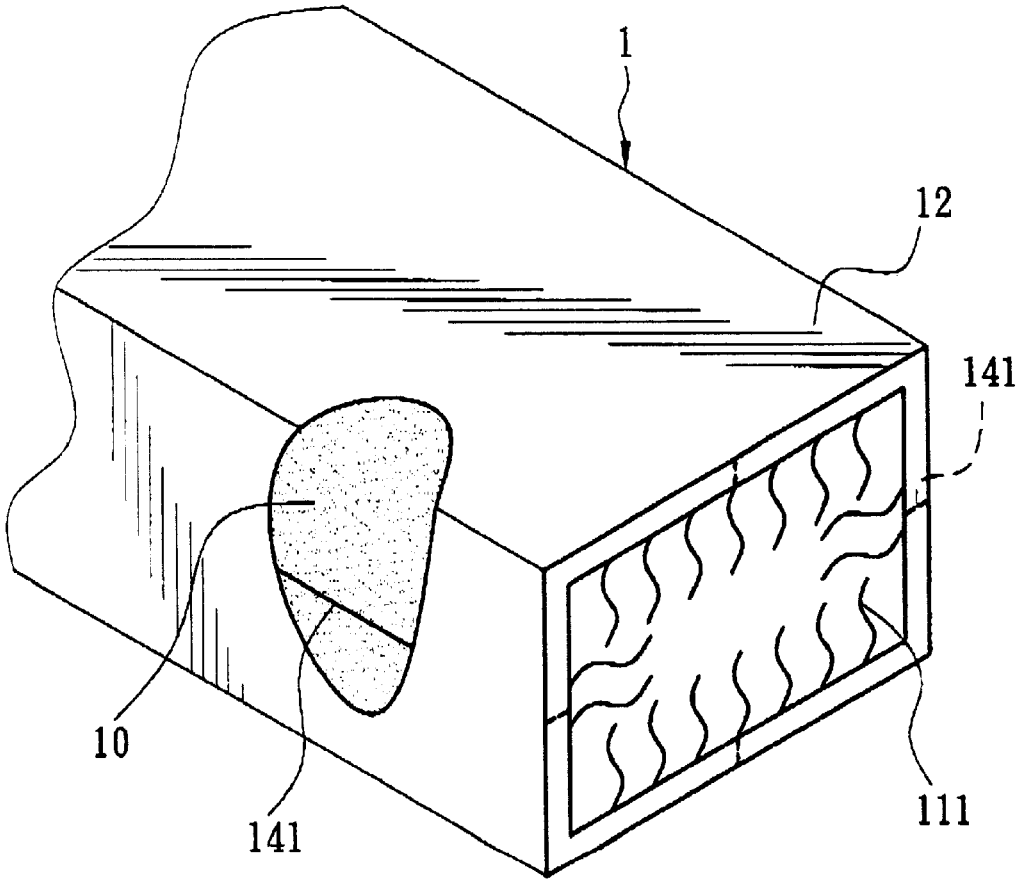

In the third preferred embodiment shown in FIGS. 4 and 5, as compared with the second preferred embodiment, the fluid conduit 1 further includes a plurality of reinforcing ribs 141 that extend radially, outwardly and integrally from an outer wall surface of the inner tube 11 so as to connect with an inner wall surface of the outer tube 12.

Figure 6:
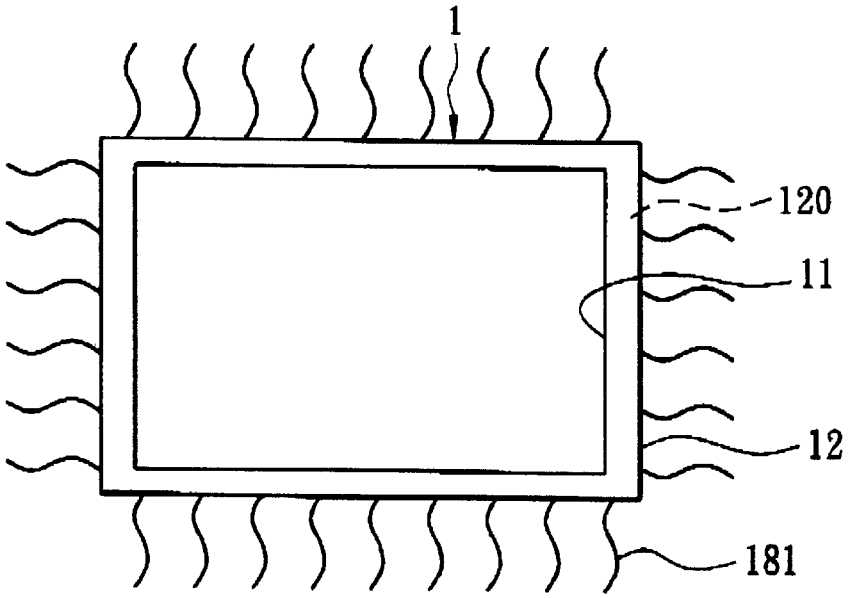
FIGS. 6 and 7 are end views of fourth and fifth preferred embodiments of the fluid conduit according to this invention.

In the fourth preferred embodiment shown in FIG. 6, as compared with the first preferred embodiment, the fluid conduit 1 further has a plurality of thermal conducting fins 181 which extend radially, outwardly and integrally from an outer wall surface of the outer tube 12.

Figure 7:
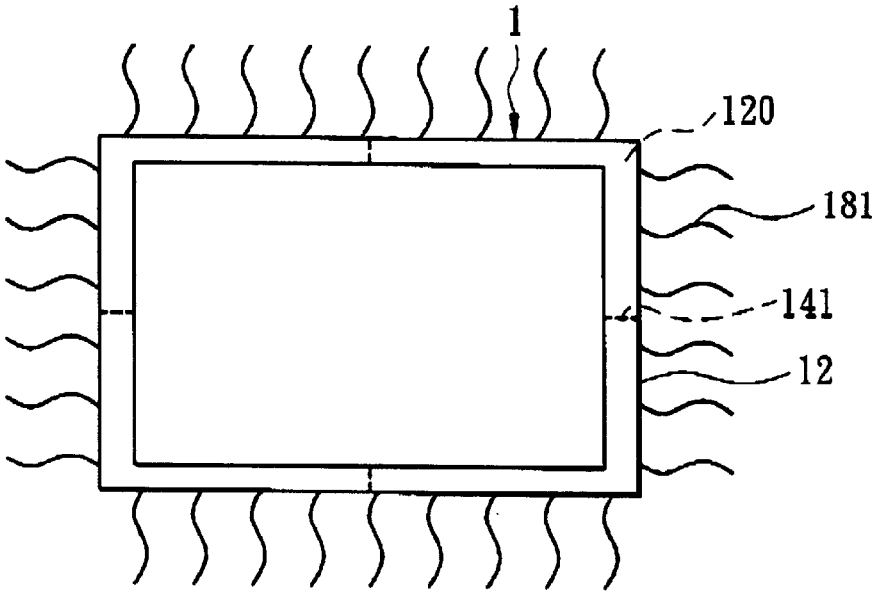

In the fifth preferred embodiment shown in FIG. 7, as compared with the fourth preferred embodiment, the fluid conduit 1 further includes a plurality of reinforcing ribs 141 that extend radially, outwardly and integrally from an outer wall surface of the inner tube 11 so as to connect with an inner wall surface of the outer tube 12.

Figure 8:
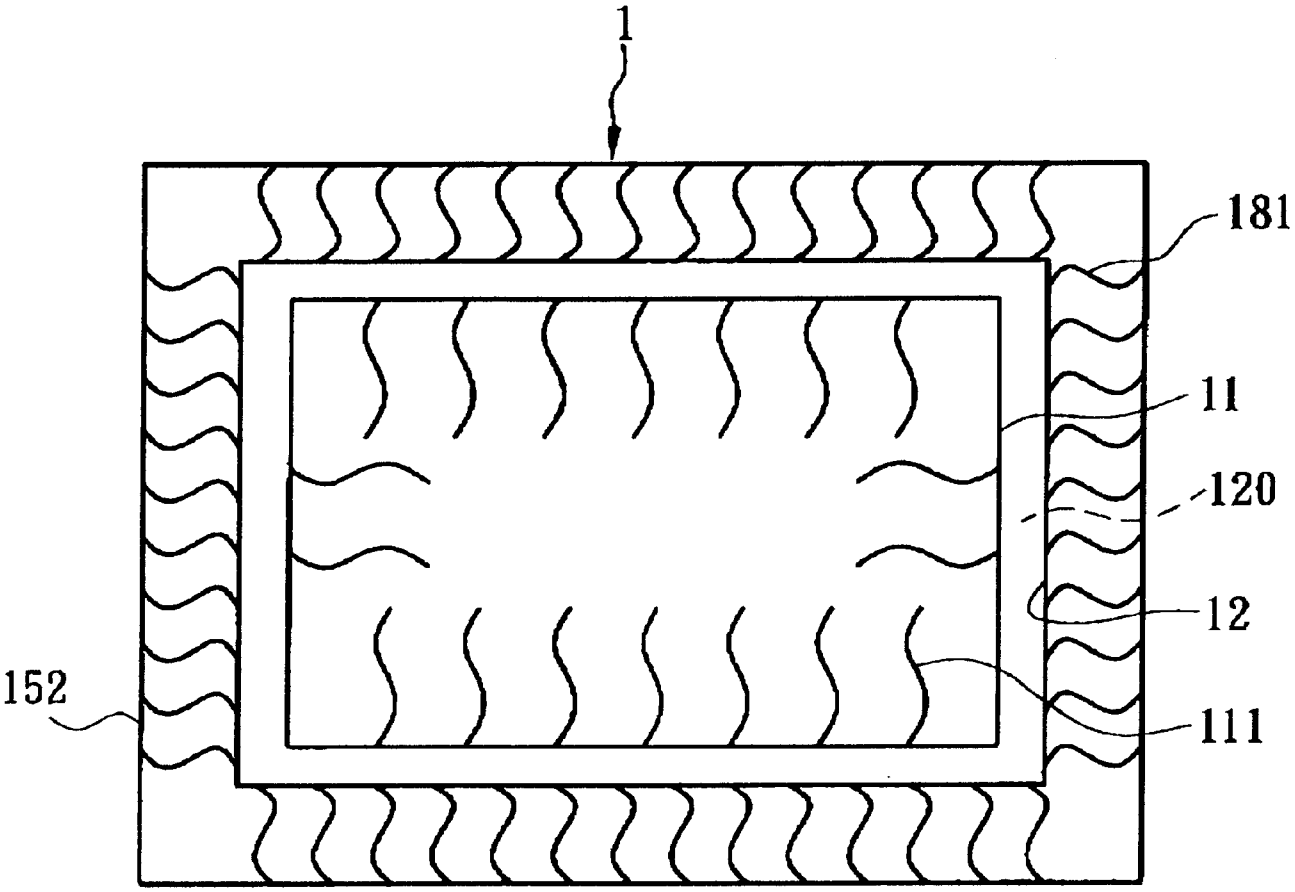
FIGS. 8 and 9 are end views of sixth and seventh preferred embodiments of the fluid conduit according to this invention.

In the sixth preferred embodiment shown in FIG. 8, as compared with the second preferred embodiment, the fluid conduit 1 further includes a tubular shield 152 which is made of a heat-conductive material, which is disposed concentrically around the outer tube 12, and which is connected to the outer tube 12 via a plurality of thermal conducting fins 181.

Figure 9:
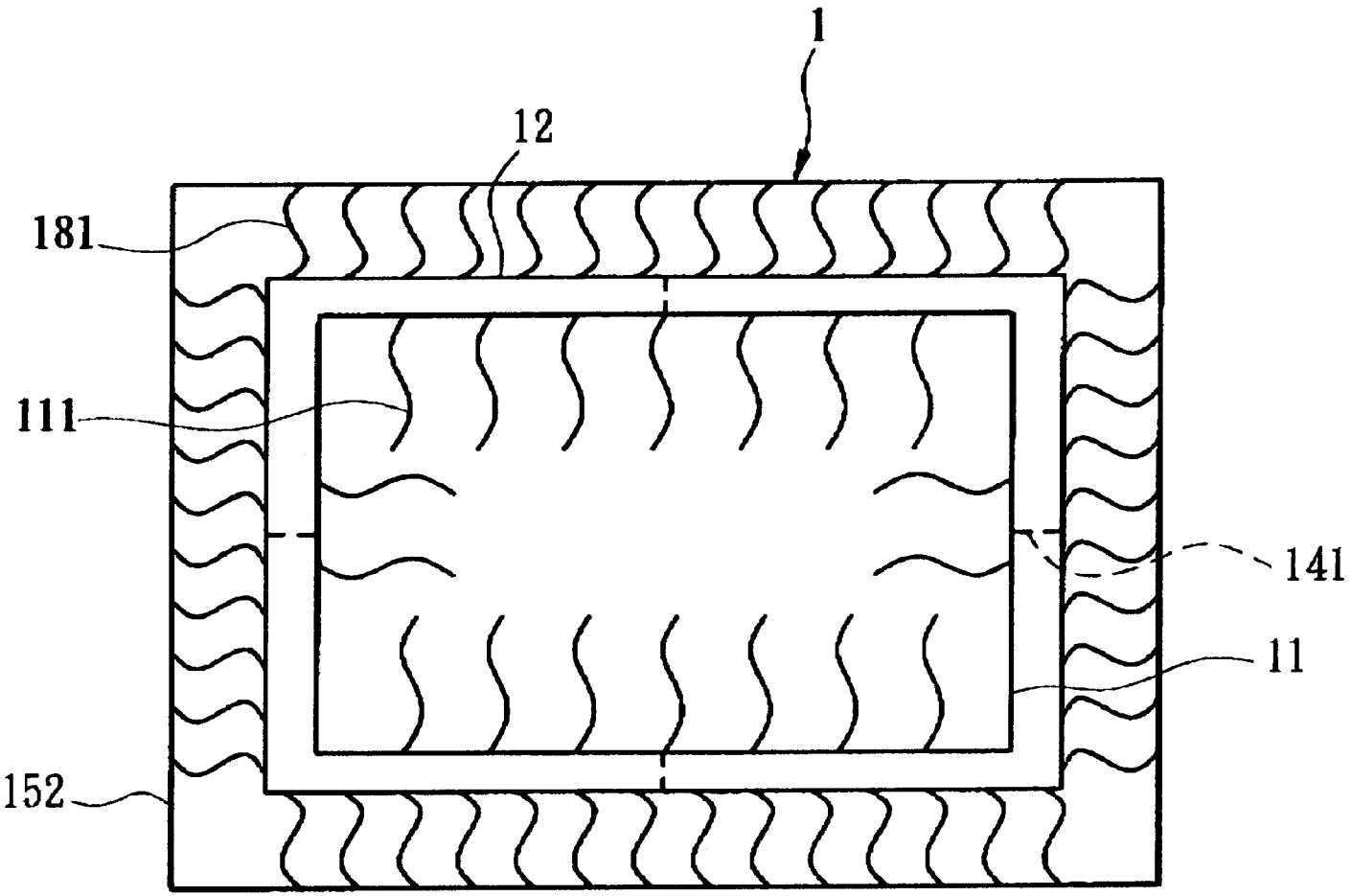

In the seventh preferred embodiment shown in FIG. 9, as compared with the sixth preferred embodiment, the fluid conduit 1 further includes a plurality of reinforcing ribs 141 that extend radially, outwardly and integrally from an outer wall surface of the inner tube 11 so as to connect with an inner wall surface of the outer tube 12.

Figure 10:
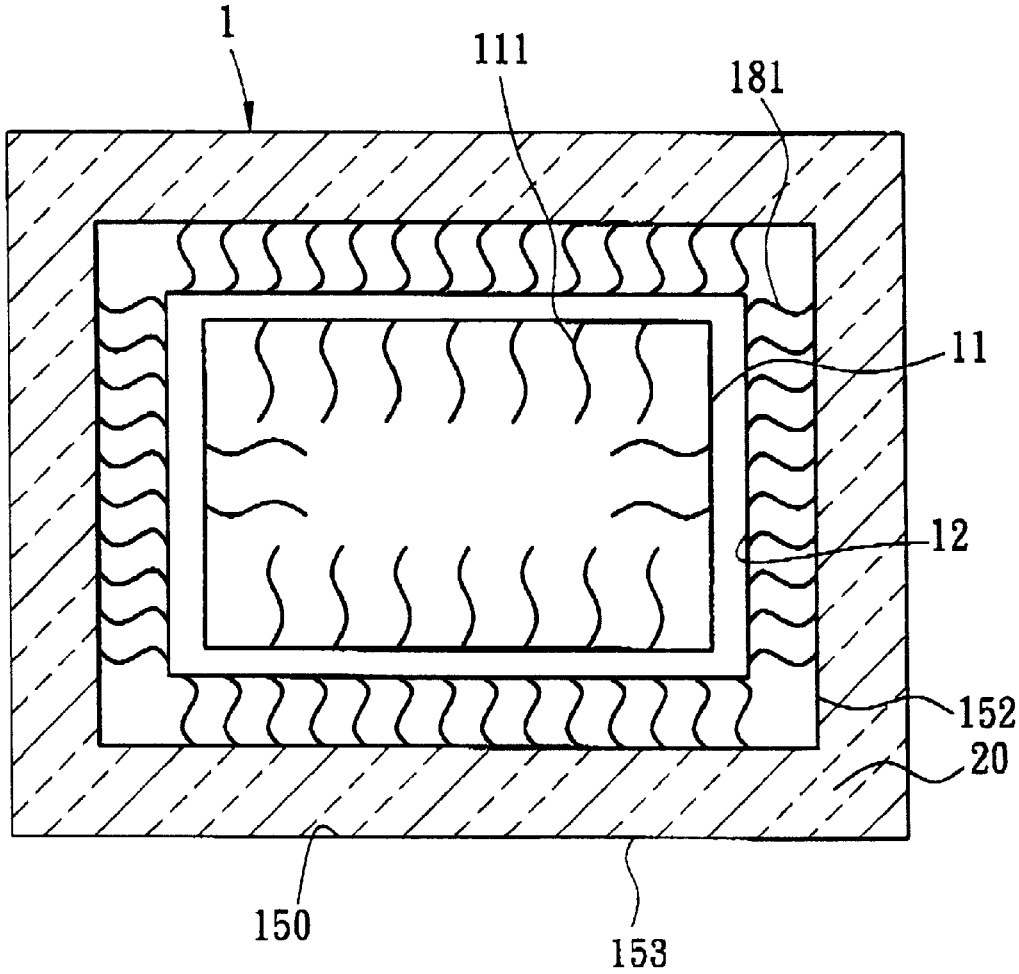
FIG. 10 and 11 are end views of eighth and ninth preferred embodiments of the fluid conduit according to this invention.

In the eighth preferred embodiment shown in FIG. 10, as compared with the sixth preferred embodiment, the fluid conduit 1 further includes a tubular metal frame 153 which is disposed concentrically around the tubular shield 152 and which cooperates with the tubular shield 152 to form a filler chamber 150 that is filled with a filler material 20 therein, such as a flame-resistant material or a heat-insulating material.

Figure 11:
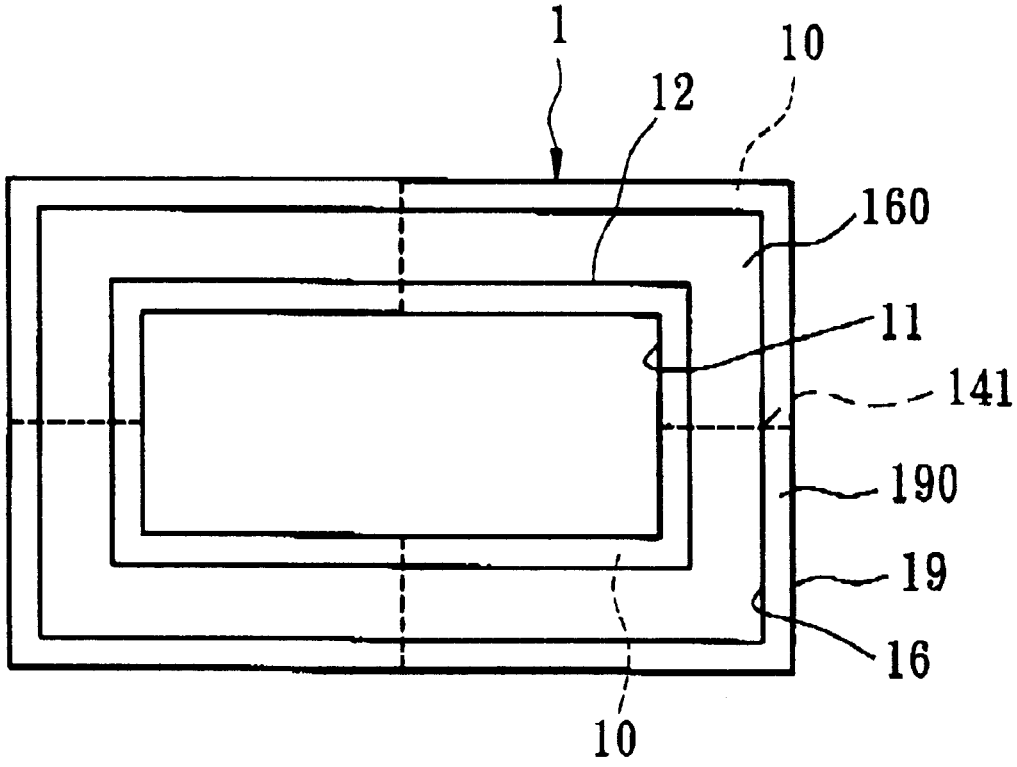

As shown in FIG. 11, as compared to the first preferred embodiment, the fluid conduit 1 of the ninth preferred embodiment further includes a hollow first tube 16 and a hollow second tube 19. The first tube 16 is made of a heat-conducting material, is disposed concentrically around the outer tube 12, and cooperates with the outer tube 12 to form a third chamber 160 that is adapted to permit passage of a coolant therethrough. The second tube 19 is made of a heat-conducting material, is disposed concentrically around the first tube 16, and cooperates with the first tube 16 to form a fourth chamber 190. The fourth chamber 190 has opposing closed ends and is filled with a superconductor material 10. A plurality of radial reinforcing ribs 141 interconnect the inner, outer, first and second tubes 11, 12, 16, 19.

Figure 12:
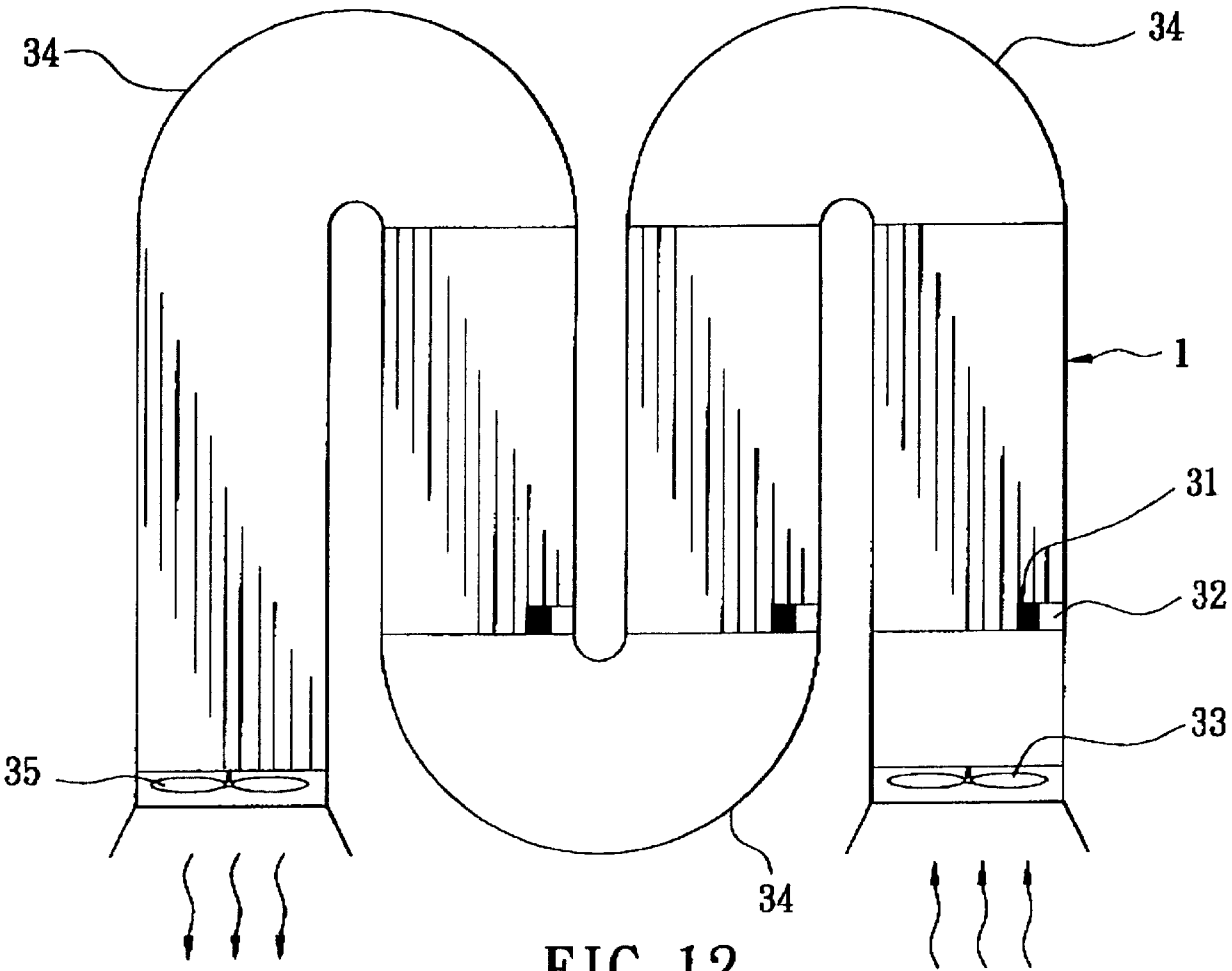
FIG. 12 is a schematic view showing an air ventilation apparatus with a plurality of fluid conduits and conduit connectors.

As shown in FIG. 12, an air ventilation apparatus includes three fluid conduits 1 described above, a fan 33 which is connected to one of the fluid conduits 1 for drawing air into the fluid conduit 1, and a plurality of curved conduit connectors 34, each of which interconnects an adjacent pair of the fluid conduits 1 so as to form a serpentine fluid duct. Another fan 35 is mounted at the downstream end of the fluid duct.

Figure 13:
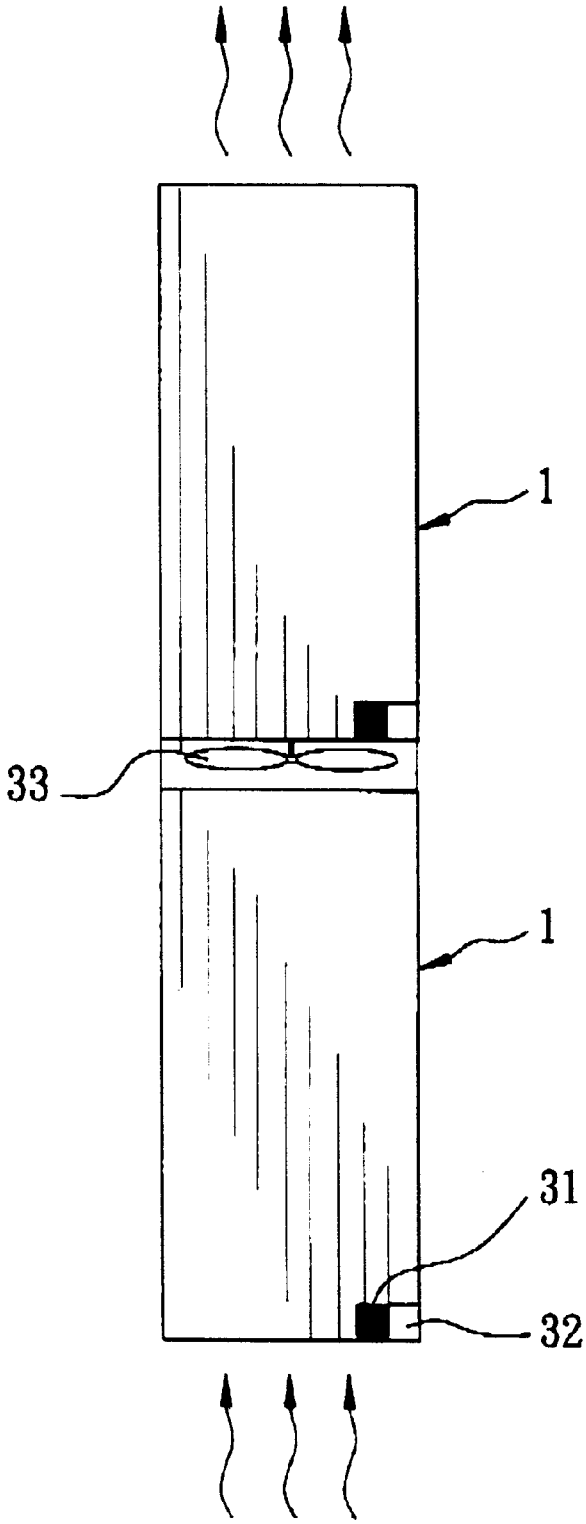
FIG. 13 is a schematic view showing an air ventilation apparatus with two fluid conduits and a fan connected therebetween.

As shown in FIG. 13, another air ventilation apparatus includes two fluid conduits 1 which are aligned with each other longitudinally, and a fan 33 which is connected to and which is disposed between the fluid conduits 1.

Figure 14:
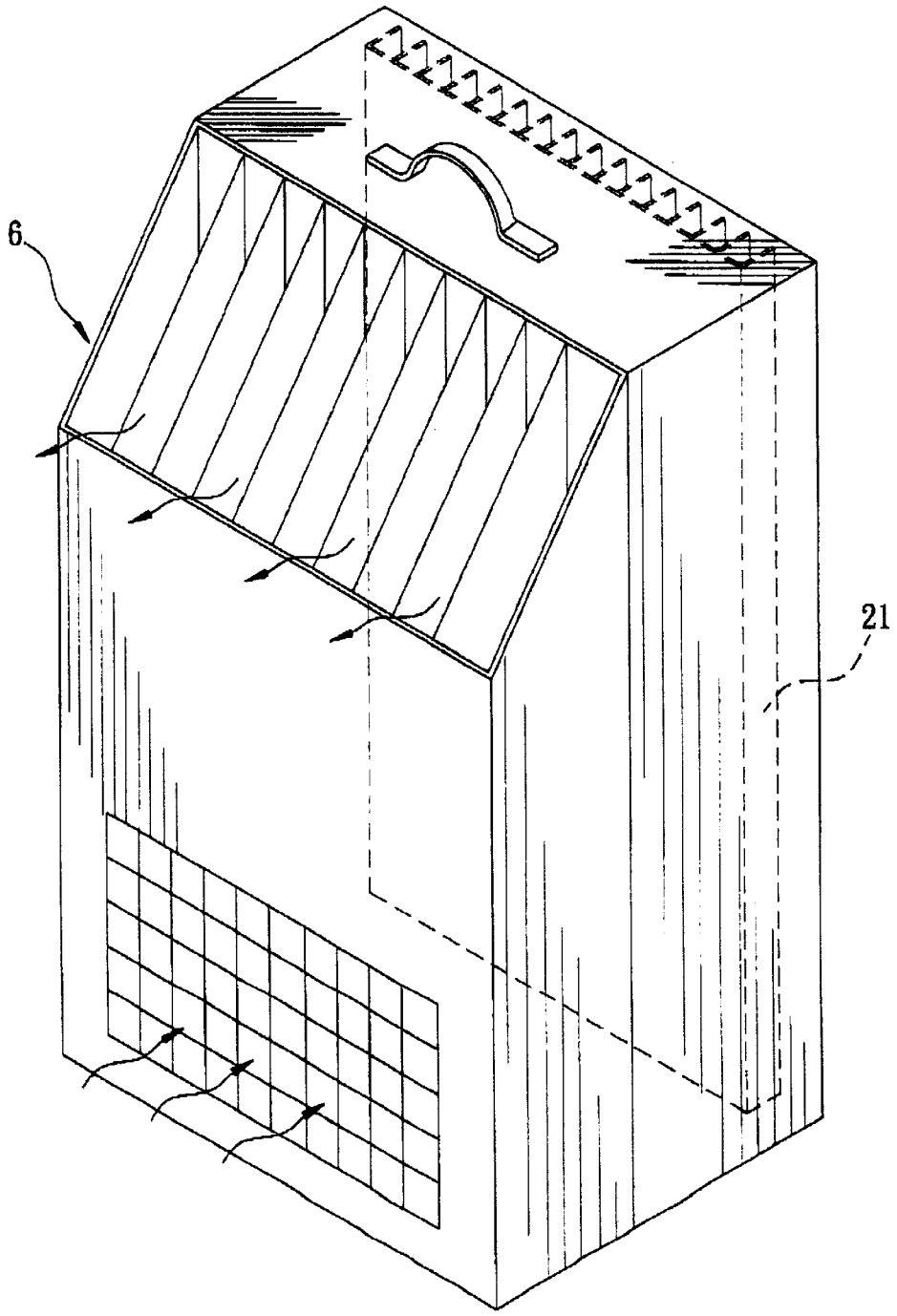
FIG. 14 is a perspective view of an air conditioning device in which the air ventilation apparatus according to this invention is installed.
Figure 15:
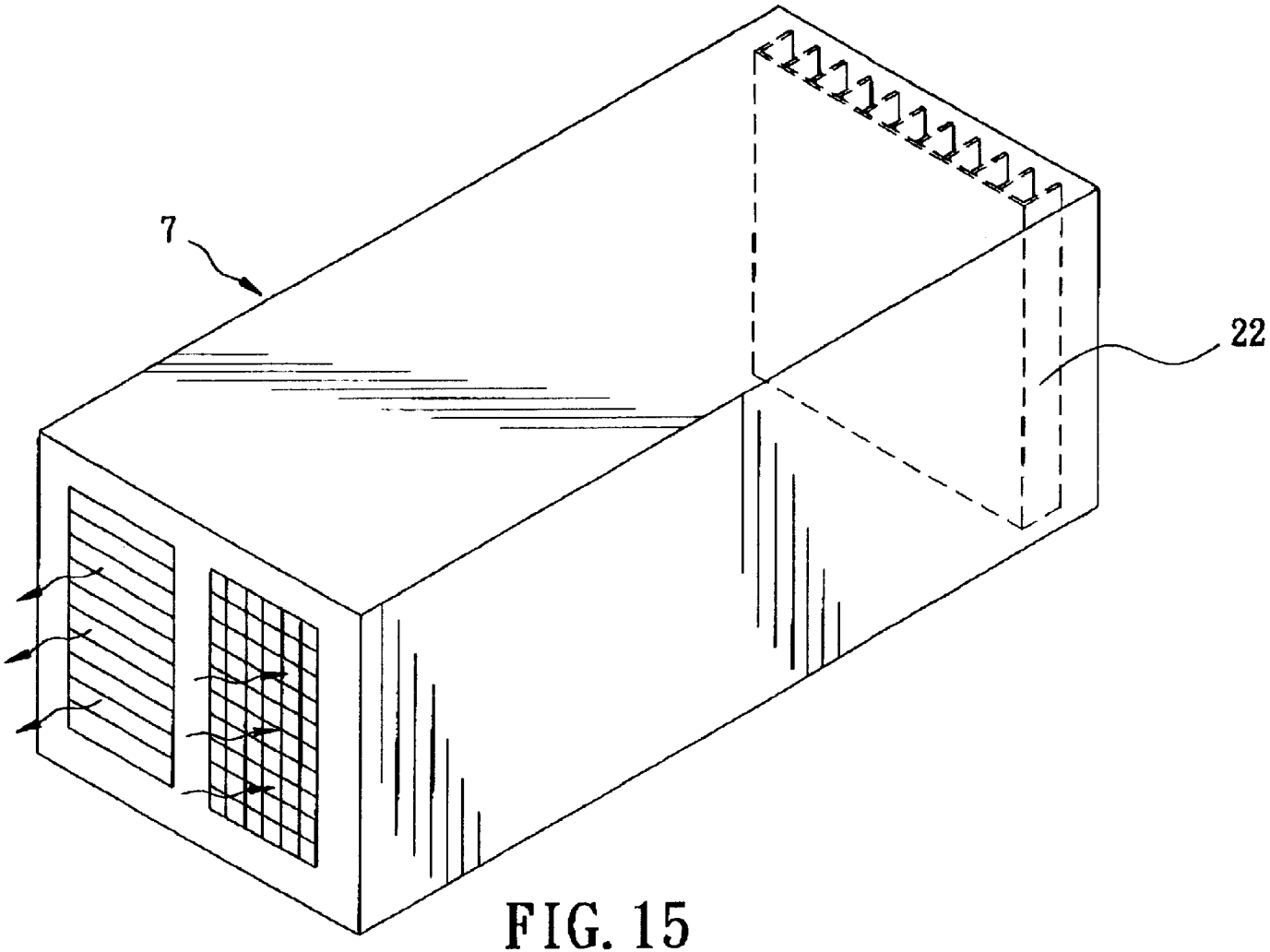
FIG. 15 is a perspective view of another air conditioning device in which the air ventilation apparatus according to this invention is installed.

The two types of the air ventilation apparatus can be installed in an air conditioning system 6 (as shown in FIG. 14) and a room air conditioning device 7 (as shown in FIG. 15). Each of the air conditioning system 6 and device 7 has a heat dissipating member 21, 22 mounted therein for dissipating the heat from the fluid conduit (not shown). A water collecting pan or a draining hose (not shown) can be mounted underneath the system 6 and device 7 for collecting and draining the water condensate from air.

Figure 16:
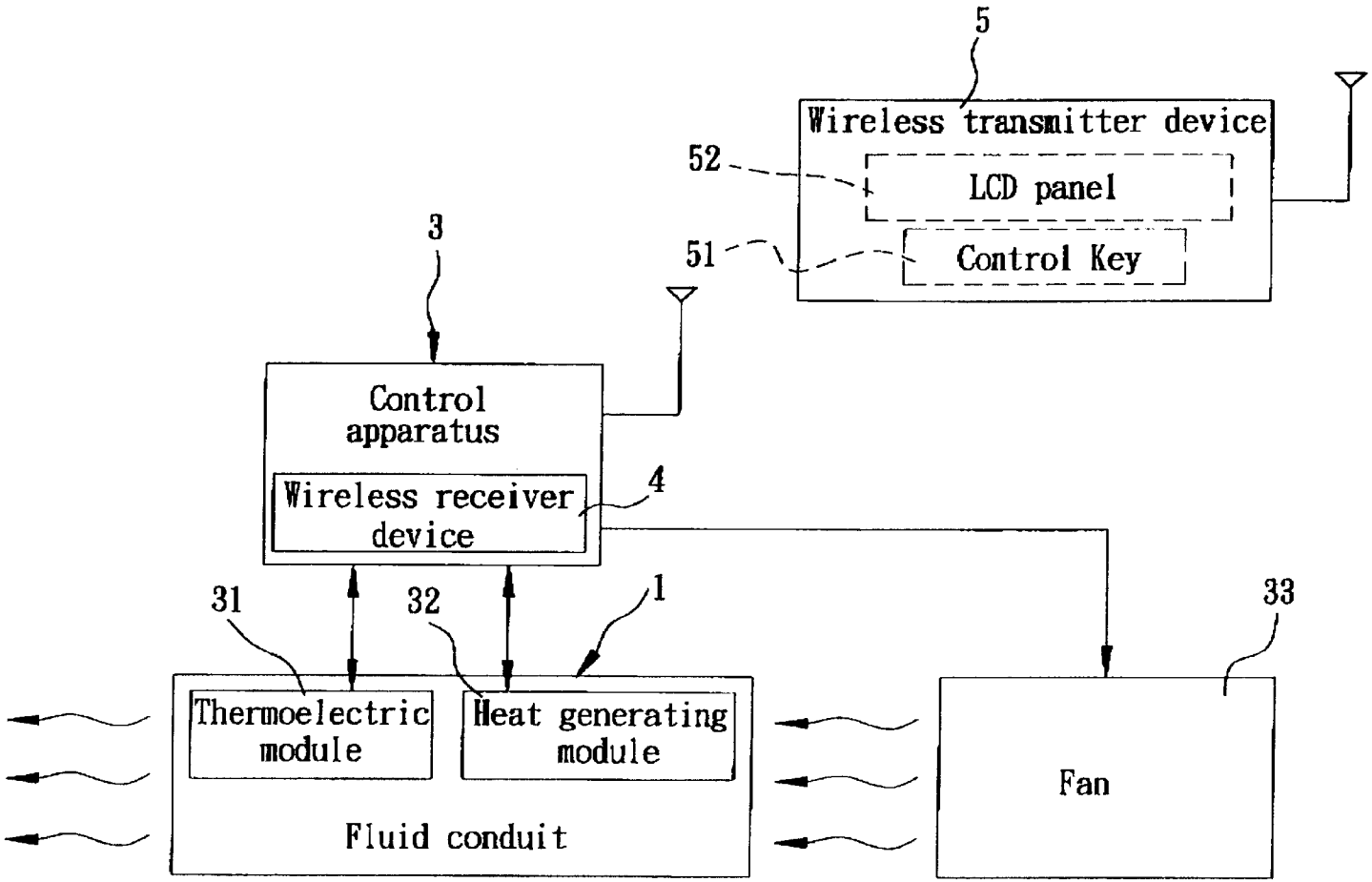
FIG. 16 is a schematic block diagram of an air ventilation apparatus according to this invention.

As shown in FIG. 16, the air ventilating apparatus of this invention further includes a control apparatus 3 which is connected electrically to and which controls operation of the thermoelectric module 31, the heat generating module 32 and the fan 33. The control apparatus 3 includes a wireless receiver device 4 which is connected electrically to and which controls operation of the thermoelectric module 31, the heat generating module 32 and the fan 33. A wireless transmitter device 5 is operable so as to transmit a wireless control signal to be received by the wireless receiver device 4 for controlling operation of the thermoelectric module 31, the heat generating module 32 and the fan 33. A control key 51 and an LCD panel 52 are mounted on the wireless transmitter device 5 and is operated to control the operations of the thermoelectric module 31 and the heat generating module 32 and to set a desired room temperature.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A fluid conduit comprising:

a hollow inner tube that is made of a heat-conducting material and that confines a first chamber; and a hollow outer tube that is made of a heat-conducting material, that is disposed concentrically around said inner tube, and that cooperates with said inner tube to form a second chamber;

one of said first and second chambers being adapted to permit passage of fluid therethrough;

the other one of said first and second chambers having opposing closed ends and being filled with a superconductor material.

2. The fluid conduit of claim 1, wherein said second chamber is filled with said superconductor material.

3. The fluid conduit of claim 2, further comprising a thermoelectric module mounted on said outer tube.

4. The fluid conduit of claim 2, further comprising a heat generating module mounted on said outer tube.

5. The fluid conduit of claim 2, further comprising a plurality of thermal conducting fins that extend radially and inwardly from an inner wall surface of said inner tube into said first chamber.

6. The fluid conduit of claim 1, further comprising a plurality of reinforcing ribs that extend radially and outwardly from an outer wall surface of said inner tube so as to connect with an inner wall surface of said outer tube.

7. The fluid conduit of claim 1, further comprising a plurality of thermal conducting fins that extend radially and outwardly from an outer wall surface of said outer tube.

8. The fluid conduit of claim 7, further comprising a tubular shield that is made of a heat-conductive material, that is disposed concentrically around said outer tube, and that is connected to said outer tube via said thermal conducting fins.

9. The fluid conduit of claim 8, further comprising a tubular metal frame that is disposed concentrically around said tubular shield and that cooperates with said tubular shield to form a filler chamber that is filled with a filler material therein.

10. The fluid conduit of claim 9, wherein the filler material is a flame-resistant material.

11. The fluid conduit of claim 9, wherein the filler material is a heat-insulating material.

12. The fluid conduit of claim 2, further comprising:

a hollow first tube that is made of a heat-conducting material, that is disposed concentrically around said outer tube, and that cooperates with said outer tube to form a third chamber adapted to permit passage of a coolant therethrough; and a hollow second tube that is made of a heat-conducting material, that is disposed concentrically around said first tube, and that cooperates with said first tube to form a fourth chamber, said fourth chamber having opposing closed ends and being filled with a superconductor material.

13. The fluid conduit of claim 12, further comprising a plurality of radial reinforcing ribs that interconnect said inner, outer, first and second tubes.

14. The fluid conduit of claim 1, wherein said inner and outer tubes are formed integrally by extrusion.

15. The fluid conduit of claim 1, wherein the fluid is air.

16. The fluid conduit of claim 1, wherein said superconductor material is in powder form.

17. An air ventilation apparatus comprising a fluid conduit and a fan connected to said fluid conduit for drawing air into said fluid conduit, said fluid conduit including a hollow inner tube that is made of a heat-conducting material and that confines a first chamber, and a hollow outer tube that is made of a heat-conducting material, that is disposed concentrically around said inner tube, and that cooperates with said inner tube to form a second chamber, one of said first and second chambers permitting passage of the air drawn by said fan therethrough, the other one of said first and second chambers having opposing closed ends and being filled with a superconductor material.

18. The air ventilation apparatus of claim 17, wherein said second chamber is filled with said superconductor material.

19. The air ventilation apparatus of claim 18, wherein said fluid conduit further includes a thermoelectric module mounted on said outer tube.

20. The air ventilation apparatus of claim 19, wherein said fluid conduit further includes a heat generating module mounted on said outer tube.

21. The air ventilation apparatus of claim 20, further comprising a control apparatus connected electrically to and controlling operation of said thermoelectric module, said heat generating module and said fan.

22. The air ventilation apparatus of claim 21, wherein said control apparatus includes a wireless receiver device connected electrically to and controlling operation of said thermoelectric module, said heat generating module and said fan.

23. The air ventilation apparatus of claim 22, further comprising a wireless transmitter device operable so as to transmit a wireless control signal to be received by said wireless receiver device for controlling operation of said thermoelectric module, said heat generating module and said fan.

24. The air ventilation apparatus of claim 18, wherein said fluid conduit further includes a heat generating module mounted on said outer tube.

25. The air ventilation apparatus of claim 18, wherein said fluid conduit further includes a plurality of thermal conducting fins that extend radially and inwardly from an inner wall surface of said inner tube into said first chamber.

26. The air ventilation apparatus of claim 18, wherein said fluid conduit further includes:

a hollow first tube that is made of a heat-conducting material, that is disposed concentrically around said outer tube, and that cooperates with said outer tube to form a third chamber adapted to permit passage of a coolant therethrough; and a hollow second tube that is made of a heat-conducting material, that is disposed concentrically around said first tube, and that cooperates with said first tube to form a fourth chamber, said fourth chamber having opposing closed ends and being filled with a superconductor material.

27. The air ventilation apparatus of claim 26, wherein said fluid conduit further includes a plurality of radial reinforcing ribs that interconnect said inner, outer, first and second tubes.

28. The air ventilation apparatus of claim 17, wherein said fluid conduit further includes a plurality of reinforcing ribs that extend radially and outwardly from an outer wall surface of said inner tube so as to connect with an inner wall surface of said outer tube.

29. The air ventilation apparatus of claim 17, wherein said fluid conduit further includes a plurality of thermal conducting fins that extend radially and outwardly from an outer wall surface of said outer tube.

30. The air ventilation apparatus of claim 17, wherein said inner and outer tubes are formed integrally by extrusion.

31. The air ventilation apparatus of claim 17, wherein said superconductor material is in powder form.

32. The air ventilation apparatus of claim 17, comprising two of said fluid conduits, said fan being connected to and being disposed between said fluid conduits.

33. The air ventilation apparatus of claim 17, comprising a plurality of said fluid conduits, and further comprising a plurality of conduit connectors, each of which interconnects an adjacent pair of said fluid conduits.

* * * * *